US005771588A

United States Patent [19]

Petrich

[11] Patent Number: 5,771,588

[45] Date of Patent: Jun. 30, 1998

[54] FOLDING AX

[76] Inventor: Richard F. Petrich, 310 W. Knepp, Fullerton, Calif. 92832

[21] Appl. No.: 790,747

[22] Filed: Jan. 27, 1997

[51] Int. Cl.[6] ..... B26B 23/00

[52] U.S. Cl. ..... 30/308.2; 30/153

[58] Field of Search ..... 30/153, 155, 161, 30/308.1, 308.2, 254

[56] References Cited

U.S. PATENT DOCUMENTS

| | | | |
|---|---|---|---|
| 1,457,930 | 5/1923 | Nelems | 30/308.2 |
| 1,515,688 | 4/1924 | Love | 30/308.2 |
| 1,614,949 | 3/1927 | Finley | 30/308.2 |
| 1,795,227 | 10/1931 | Miller et al. | 30/308.2 |
| 2,193,708 | 3/1940 | Bergvist et al. | 30/308.2 |
| 2,377,730 | 6/1945 | Vosbikian | 30/208.1 |
| 2,793,664 | 5/1957 | Warrington, Sr. | 30/308.2 |
| 2,989,100 | 6/1961 | Surdis et al. | 30/308.2 |
| 4,106,539 | 8/1978 | Petrich | 30/308.2 |

*Primary Examiner*—Hwei-Siu Payer
*Attorney, Agent, or Firm*—Cleveland R. Williams, III

[57] ABSTRACT

A folding ax is described which is compact in the folded position and exhibits superior strength, safety and self lubricating characteristics when in the open or use position. The folding ax comprises an ax head pivotally attached to a first shaft. The first shaft is pivotally to a second shaft which is in turn pivotally attached to a third shaft. Each shaft contains an elongated central channel or cavity. The folding ax contains three separate locking elements, including stabilizing element and is equipped with self lubricating washers.

7 Claims, 3 Drawing Sheets

FOLDING AX

BACKGROUND OF THE INVENTION

1. Field of the Invention

This invention relates to a folding ax having a pivotable blade equipped with locking means. The ax blade is foldable into a first channel shaft specifically constructed to receive a portion of said blade. A second channel shaft pivotably connected to the first channel shaft pivots around and receives another portion of the blade in the folded position. A third locking shaft is pivotally connected to the second channel shaft and has a cavity to receive a portion of said second channel shaft. The locking shaft has locking means for latching onto a dowel pin or similar structure located on the first channel shaft.

In the extended position, the folding ax head pivots around pivot means and locks into place in the first channel shaft. The second channel shaft pivots around pivot means which connects the first and second channel shafts and locks in place with locking means connected to the first channel shaft and the locking shaft. The folding ax contains self-lubricating means in contact with all pivot means.

As a safety feature the first channel shaft which is attached to the ax head contains a round surface on the back thereof. This feature discourages the user from using the ax as a hammer and possibly causing the ax head to disengage from the locked position when in use, with the ensuing injury to the user's hand.

The ax head is preferably constructed from Rockwell C-49 chromium steel or a steel with similar physical characteristics. The other members of the ax herein can conveniently be constructed from heavy gauge formed steel.

2. Description of the Prior Art

Various camping axes have been utilized in the past for outdoor activities, some of which have folding characteristics.

For example, U.S. Pat. No. 1,457,930 to Nelems relates to a combination tool consisting of a folding hatchet and a digging blade. The hatchet blade is mounted in its handle in such a manner, so that it can be folded into or out of operating position and very securely clamped into either position by a single thumb screw.

U.S. Pat. No. 1,515,688 to Love describes a folding ax which consists of a handle, the upper portion of which is bifurcated. The ax head is adapted to be pivotally and slidably supported in the bifurcated end of the handle. The ax is held in either the open or closed position using latching means.

U.S. Pat. No. 1,614,949 to Finley teaches a folding hatchet which consists of a head having a rearwardly projecting arm pivotably attached to a channel shaped handle enclosure for receiving the head in the folded position. Spring action latching means is provided to lock the folding hatchet in either the extended or folded positions.

U.S. Pat. No. 1,795,227 to Miller et al. relates to a safety ax consisting of a cutting blade mounted for movement from an exposed cutting position to a concealed inoperative position in which the cutting edge is protected, wherein the cutting head folds into and is embraced between a bifurcation formed in the handle head of the ax.

U.S. Pat. No. 1,895,342 to Pelton et al. describes an ax or hatchet type of tool in which a cutting blade is movable to a plurality of positions and which may be locked in any of these positions and released by the pressure of a finger upon a spring-pressed trigger.

U.S. Pat. No. 2,193,708 to Bergkuist et al. relates to an ax with a swingable head that is adapted to the locked in different positions. The ax head may be secured in either the swing in or swung out position by means of a locking mechanism provided with a movable tongue.

U.S. Pat. No. 2,377,730 to Vosbikian et al. teaches a combination tool consisting of an ax, a pick, a wire cutter and a shovel, wherein the ax and the pick are adapted to be folded out of the way, if desired, when not in use.

U.S. Pat. No. 2,793,664 to Warrington, Sr. describes a folding pack axe having a folding handle assembly involving a main latch and a safety or auxiliary latch so arranged that when the tool is unfolded for use the handle will be completely rigid and of sufficient strength to withstand heavy shocks when the tool is in use.

U.S. Pat. No. 2,989,100 to Surdis et al. relates to a collapsible hand axe which consists of a channel shaped holder within which is pivotably mounted an axe blade, and with a channel type handle pivotally mounted upon the other end of the holder.

U.S. Pat. No. 4,106,539 to Petrich describes a folding hatchet consisting of a channel member having a head member rotatably attached to one end of and a handle device rotably attached to the other end.

As can readily be determined from the foregoing, there is an ongoing research effort and a need to develop and produce new and novel folding hatchets or axes for camping and other activities.

SUMMARY OF THE INVENTION

The present invention resides in a folding ax which comprises an ax head having locking means and pivotally connected to a first channel shaft having a round back surface, a cavity for receiving a portion of said ax head and engaging the locking means thereof; a second channel shaft is pivotally connected to the first channel shaft having a cavity for receiving a portion of said ax head; and a third locking shaft pivotally connected to the second channel shaft having a cavity for receiving a portion of the second channel shaft and locking means to lock said third locking shaft in position in contact with locking means :connected to the first channel shaft.

DETAILED DESCRIPTION OF THE INVENTION

Figure 1:
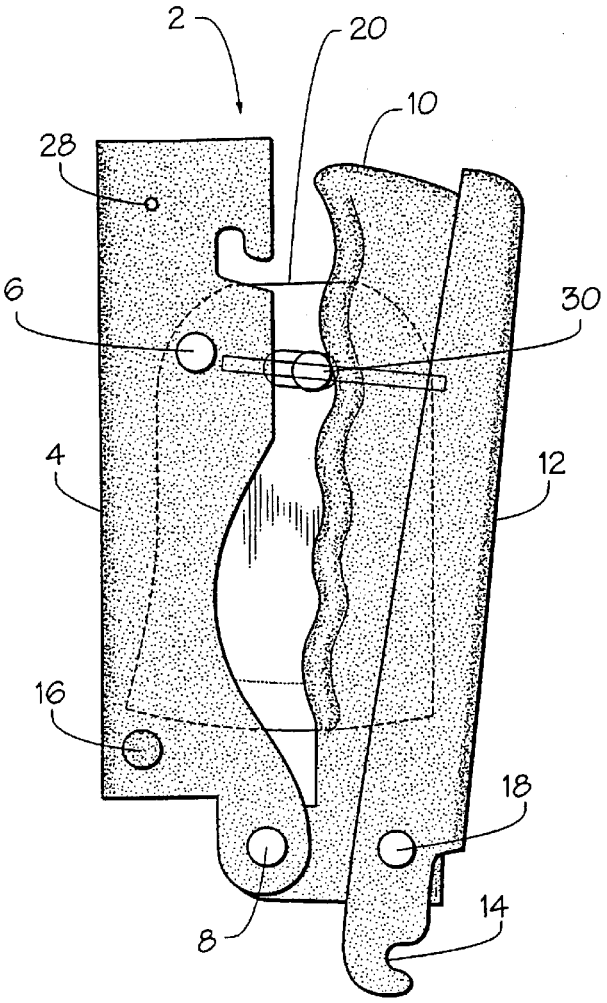
FIG. 1 is a side view of the folding ax herein in the folded position.

The present invention resides in a folding ax having improved safety features, ax strength, and self lubricating means for the points of pivot.

In particular the folding ax herein comprises an ax head, first, second and third shafts all of which are pivotally attached to each other. The first shaft has a round configuration on one side and an elongated channel on the other side. An ax head is pivotally attached on the inside and near the top portion of the first shaft. The ax head has first and second locking means including stabilizing means. The top portion of a second shaft is pivotally attached to the bottom portion of the first shaft. The second shaft has a round configuration on one side and an elongated channel on the other side for receiving the ax head in a closed configuration. A third shaft is pivotally attached to the top portion of the second shaft, said third shaft containing a round configuration on one side and an elongated channel for receiving a portion of the second shaft. The third and first shafts have locking means for locking said first, second and third shafts in a rigid configuration in the open position.

Embodiments of the folding ax of the present invention are hereinafter described with reference to the drawings, in which identical or corresponding parts are indicated by the same reference characters or numbers through the several views.

FIG. 1 illustrates a side view of the ax herein in the folded position. First shaft 4 is attached to ax head 20 at pivot point 6. First shaft 4 contains recessed area 28 and opening 2 for receiving first locking means comprising spring activated, sliding pin 30 which engages and passes through opening 2 of first shaft 4. Male locking means 16 consisting of pins projecting from both sides of first shaft 4 are attached near the bottom portion thereof. A portion of ax head 20 is located in the elongated channels (not shown) of first shaft 4 and second shaft 10. First shaft 4 is pivotally attached to second shaft 10 at pivot point 8. The two shafts are capable of rotating 180 degrees from each other, e.g. in the open position. Third shaft 12 is pivotably attached to second shaft 10 at pivot point 18. Third shaft 12 contains third latching means 14 which comprises female latching means consisting of latches on either side of said shaft which are adapted to engage and lock onto male latching means 16 attached to first shaft 4. It should be noted that pivot points 6, 8 and 18 contain self lubricating washers. The self lubricating washers are constructed of polymeric materials, such as, a polystyrene resin, acrylic resin or a polycarbonate resin to name a few. These types of washers will not rust, corrode or cause other related problems when the folding ax is exposed to harsh weather condition.

Figure 2:
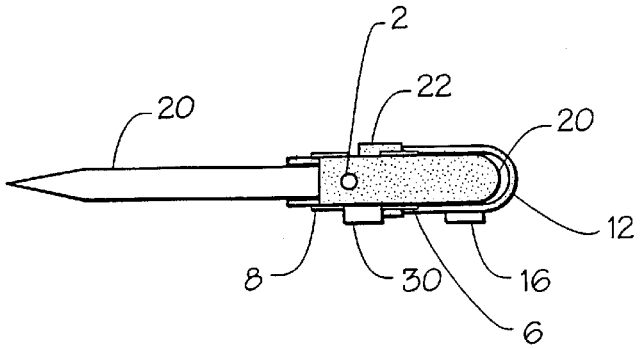
FIG. 2 is a top view taken along line 2—2 of FIG. 5.

FIG. 2 is a top view of the folding ax herein in the open position. Ax blade 20 is in the open position and attached to first shaft 4 at pivot point 6. Spring activated pin 30 engages opening 2 of first shaft 4 at opening 2, effectively locking said blade in the open position. Second shaft 10, third shaft 12, locking means 16 are also disclosed.

Figure 3:
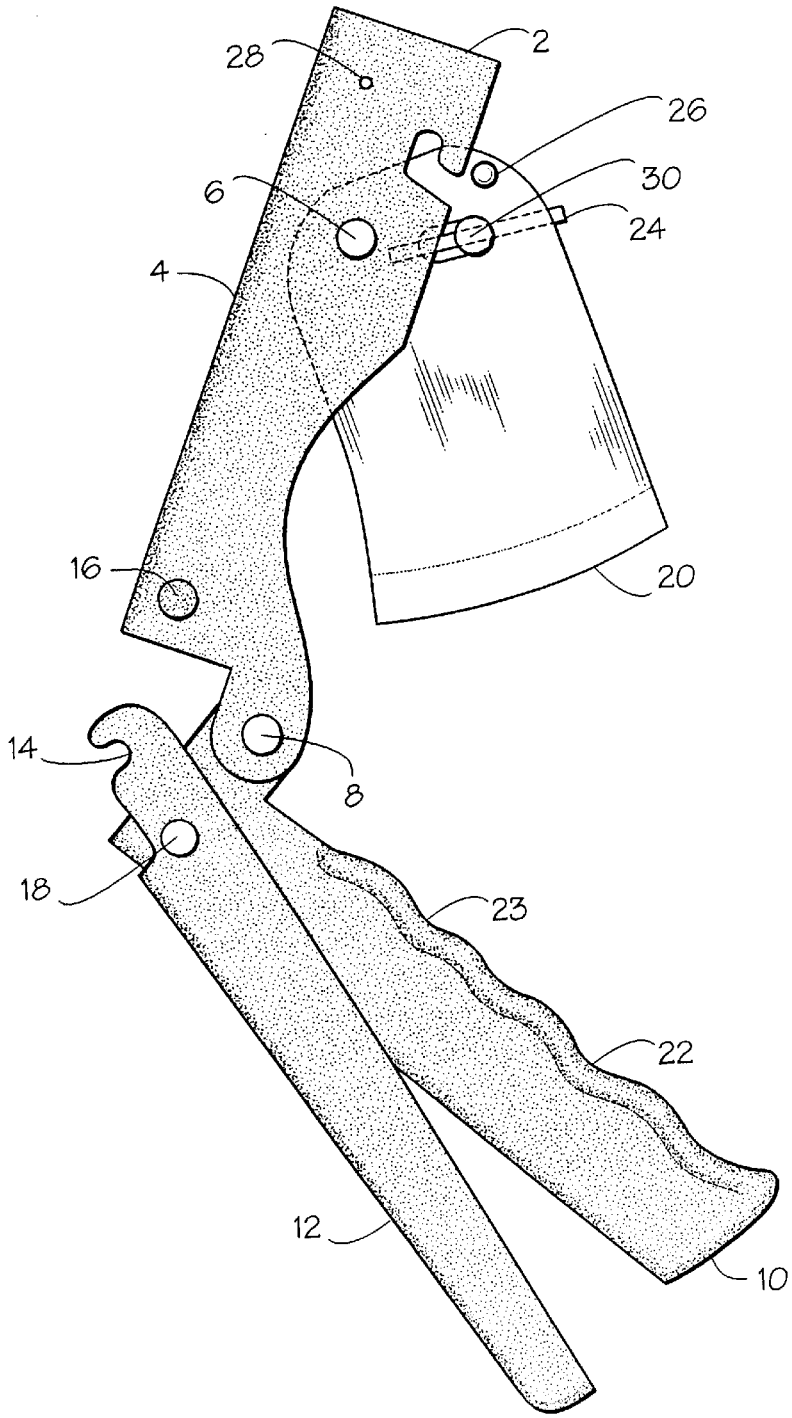
FIG. 3 is yet another side view of the ax herein in a partially open position wherein the ax blade and other elements of the ax are in a partially open position.

FIG. 3 is a side view of the folding ax herein in a partially opened position. Ax head 20 is in a partial open position where it is connected to first shaft 4 at pivot pint 6. Ax head 20 contains first locking means 30 which comprises spring actuated pin 24 which engages and passes through opening 2 of first shaft 4. Steel ball or bearing 26 is adapted to engage recess and opening 28 in first shaft 4 when ax head 20 is in the open position. The other elements of the folding ax are the same as those elements described in FIGS. 1 and 2, with the exception of elongated channel or cavity 23 (not shown) on second shaft 10. It should be noted that the first, second and third shafts each have an elongated channel or cavity therein.

Figure 4:
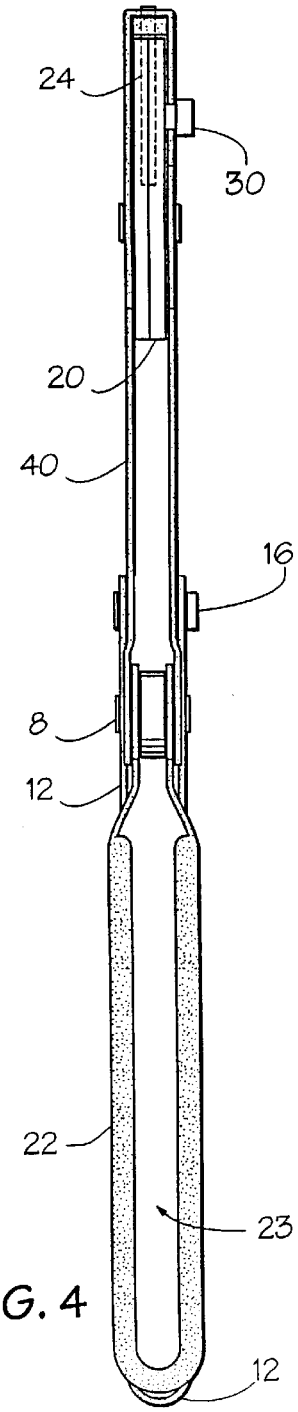
FIG. 4 is a front, cut-away, view taken along line 4—4 of FIG. 5.

FIG. 4 is a front cut-away view of the folding ax herein in the open position. Ax head 20 is attached to first shaft 4 at pivot point 6. Elongated channel 34 defines a cavity which engages and accepts blade 20 in the closed position. Second shaft 10 is attached to first shaft 4 at pivot point 8. Third shaft 12 contains an elongated channel or cavity (not shown) for partially receiving second shaft 10. Second shaft 10 contains elongated channel 23 which receives a part of ax head 20 in the closed position. Male locking means 16 which consists of a metal dowel or pin is adapted to receive female latching means consisting of a latch which engages male locking means 16.

It is to be noted that the male and female latching means constitute a third latching system for the folding ax herein.

Figure 5:
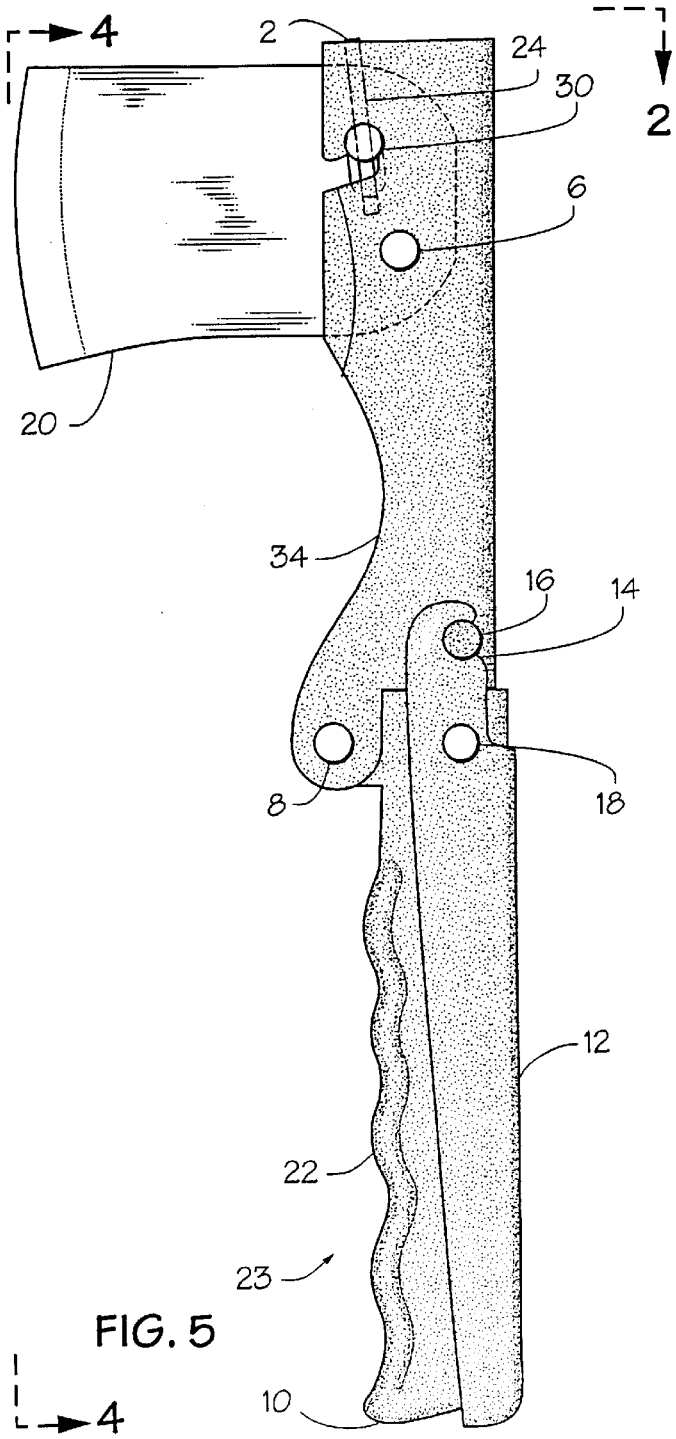
FIG. 5 is a 90 degree rotated side view of the folding ax shown in FIG. 4, wherein the ax is in the completely open position.

FIG. 5 is a 90 degree rotated, side view of the folding ax of FIG. 4 in the extended position. The various elements of this FIG have been shown and described in the previous FIG. 5 with the following exceptions. Opening 34 is adapted to receive the gripping head of first locking means 30. Wavy configuration 22 on second shaft 10 is particularly constructed and adapted to receive the human hand, especially the fingers thereof.

The folding ax herein which is also known as the PAC-AX® was subjected to a number of tests to determine the strength and durability of said ax. It should be noted that the ax head is preferably constructed from Hi-Chromium SAE5145 steel and the handles are constructed from heavy gauge formed steel.

The blade and hinge thereof was subjected to a load test using an Instron Corporation Universal Test Machine, Model TT-D which is capable of exerting 20,000 pounds of force. The ax in the open position was subjected to a three point compression test. The ax was secured at the blade and the handle. A force was applied, subjecting the ax to the forces it would experience when chopping. The maximum peak force recorded was 1,401 pounds.

Next, the ax in the open position was tested on a calibrated Rockwell Hardness tester using a Wilson Corporation Hardness Tester, Model 5EM. The ax head recorded a hardness of Rockwell C-49 and the handle recorded a hardness of Rockwell C-40.

Obviously, many modifications and variations of the invention, as hereinbefore set forth, may be made without departing from the spirit and scope thereof, and therefore, only such limitations should be imposed as are indicated in the appended claims.

I claim:

1. A folding ax comprising a first shaft having a round configuration on one side and an elongated channel on the other side, an ax head pivotally attached to one end of the first shaft inside of the elongated channel, said ax head having first and second locking means, wherein the second locking means comprises a large steel ball bearing contained in the ax head, said steel ball being adapted to fit in a recessed portion near said one end of the first shaft, a second shaft pivotally connected to the other end of the first shaft, said second shaft having a round configuration on one side and an elongated channel on the other side for receiving the ax head in a closed configuration; and a third shaft pivotally attached to the second shaft, said third shaft containing a round configuration on one side and an elongated channel for receiving a portion of the second shaft, wherein the third shaft has locking means for attaching to the first shaft, locking said first, second and third shafts in a rigid configuration in an open position.

2. The folding ax of claim 1, wherein the ax head is folded between and received in the elongated channels of the first and second shafts.

3. The folding ax of claim 1, wherein the first locking means comprises a spring actuated pin located in the ax head, which passes through an opening in said ax head and through an opening in said one end of the first shaft.

4. The folding ax of claim 1, wherein the second shaft is configured, along the outer edges of the elongated channel hereof, to receive a human hand.

5. The folding ax of claim 4, wherein the elongated channel of the second shaft has a wavy configuration adapted to receive the fingers of the human hand.

6. The folding ax of claim 1, wherein the locking means of the third shaft contains female latching means adapted for engaging male latching means on the first shaft.

7. The folding ax of claim 6, wherein the female latching means comprises a hook and the male latching means comprises pins that are projected from opposite sides of the first shaft.

* * * * *